US006717074B2

(12) United States Patent
Lu

(10) Patent No.: US 6,717,074 B2
(45) Date of Patent: Apr. 6, 2004

(54) MEMBRANE BUTTON KEY STRUCTURE WITH A BUILT-IN SPEAKER

(75) Inventor: Kuo-Ping Lu, Taipei Hsien (TW)

(73) Assignee: ASUSTeK Computer Inc., Taipei (TW)

( * ) Notice: Subject to any disclaimer, the term of this patent is extended or adjusted under 35 U.S.C. 154(b) by 0 days.

(21) Appl. No.: 10/260,393

(22) Filed: Oct. 1, 2002

(65) Prior Publication Data

US 2003/0116412 A1 Jun. 26, 2003

(30) Foreign Application Priority Data

Dec. 26, 2001 (TW) ..... 90222968 U

(51) Int. Cl.[7] ..... H01H 9/00

(52) U.S. Cl. ..... 200/5 R; 200/4; 200/512; 200/341

(58) Field of Search ..... 200/5 R, 4, 6 A, 200/511, 512, 513, 515, 520, 341, 61.58 R

(56) References Cited

U.S. PATENT DOCUMENTS 4,081,631 A * 3/1978 Feder ..... 200/5 A
6,049,290 A * 4/2000 Halstead ..... 340/825.44
6,297,806 B1 * 10/2001 Skoog ..... 345/160

* cited by examiner

*Primary Examiner*—Karl D. Easthom
*Assistant Examiner*—K. Lee
(74) *Attorney, Agent, or Firm*—Birch, Stewart, Kolasch & Birch, LLP

(57) ABSTRACT

A membrane button key structure with a built-in speaker consists of a membrane key, a bottom lid and a speaker. The membrane key includes a four-way key and a plurality of hot keys connecting with one another through a membrane and corresponding to touch switches located on a circuit board. The circuit board has a carved opening with the center of the four-way key located thereabove and the bottom lid located therebelow to form a housing compartment to accommodate the speaker. Besides housing the speaker, the extra space of the housing compartment functions as an acoustic chest for the speaker.

6 Claims, 5 Drawing Sheets

MEMBRANE BUTTON KEY STRUCTURE WITH A BUILT-IN SPEAKER

FIELD OF THE INVENTION

The present invention relates to a membrane button key structure for electronic devices and particularly a membrane button key structure with a built-in speaker.

BACKGROUND OF THE INVENTION

Due to continuous innovations of electronic techniques and rapid developments of digital technologies, 3C information products have become indispensable outfits and helpful working tools for many people. 3C information products include notebook computers, mobile phones, personal digital assistants (PDAs), Palm computers (Palms) and the like. PDA, because of its powerful functions, user-friendliness and light and compact size, has been widely accepted by consumers. In addition, PDA can also include many other functions such as to access the Internet in a wireless fashion, communication, and video/audio enabling. It has becomes a prevailing trend of the information product development nowadays.

Refer to FIG. 1 for a conventional PDA. It includes a casing 10, a display panel 12 and a membrane key 14. The casing 10 has a plurality of openings formed on the surface to match and accommodate the display panel 12 and the membrane key 14. The keys 140 of the membrane key 14 are extending above the openings. Users can depress the keys 140 to perform the operations of the PDA. The information are displayed on the display panel 12.

Refer to FIG. 2 for the membrane key of adopted by conventional techniques. The membrane key 20 includes a four-way key 21 and a plurality of hot keys 22. The keys 21 and 22 are interconnected by a membrane 23. The entire membrane key 20 is integrally formed from a pliable rubber. The four-way key 21 has four bulged points 24 located on a lower side of four corners. Each hot key 22 also has a bulged point 22 located thereunder. There is a circuit board 25 located below the membrane key 20. The circuit board 25 has a plurality of touch switches 26 located on the surface thereof. The bulged points 24 below the keys 21 and 22 correspond to the touch switches 26 of the circuit board 25. Users may enter input commands on the PDA by depressing the keys 21 and 22 to move the bulged points 24 located therebelow in contact with the touch switches 26 of the circuit board 25. The input commands are processed and the results are displayed on the display panel (not shown in the drawings).

These days, PDA equipped with video/audio or mobile phone capabilities has become a hotly pursued trend. One of the critical elements to achieve the aforesaid functions is the speaker. To make the PDA competitive, it must by lean and light, and has a big enough display screen. To meet those requirements, conventional techniques of PDA have fully utilized the internal space of the casing for the configuration of the necessary elements and keys. It is very difficult to allocate an additional space for the speaker. When trying to adopt the conventional techniques to add the speaker on the front side of the PDA without increasing the total size, the size of the display panel has to be shrunk. To keep the speaker on the front side of the PDA without reducing the size of the display panel, total size of the PDA should be increased. To install the speaker on the rear side of the PDA will increase the total thickness. Besides, when the speaker is located on the rear side of the PDA, the audio quality is not desirable. When it is coupled with the mobile phone, the voice output from the rear side has the risk of being eavesdropped.

Because of the conventional techniques have difficulty to include the speaker in the PDA and still meet the requirements of lean and light and a large enough display screen, it is necessary to develop new techniques to resolve the problem.

SUMMARY OF THE INVENTION

Therefore the primary object of the invention is to provide a membrane button key structure with a built-in speaker to offer PDAs or the related electronic products with audio function without increasing the thickness and size of the product, or reducing the size of the display screen.

The membrane button key structure with a built-in speaker of the invention is adopted for use on PDAs or the related electronic products. The PDA includes a circuit board which has a plurality of touch switches and a carved opening on the surface thereof. The invention includes a membrane key, a bottom lid and a speaker. The membrane key consists of a four-way key and a plurality of hot keys interconnected by a membrane which is integrally made from a pliable rubber. The four-way key has four bulged points located on bottom side of four corners. Each hot key also has a bulged point located on the bottom in the center thereof. When the membrane key is coupled above the circuit board, each key located under the membrane key corresponds to a touch switch of the circuit board. The center of the four-way key is above the carved opening. The bottom lid is under the carved opening and forms a housing compartment with the four-way key for housing the speaker in the middle thereof. The space between the speaker and the four-way key becomes an upper acoustic chest and the space between the speaker and the bottom lid becomes a lower acoustic chest.

The invention aims at installing the speaker below the four-way key of the membrane key without increasing the total thickness and size of the PDA, or reducing the size of the display screen. The circuit board below the four-way key is properly carved to coupled with a bottom lid to form a housing compartment with the four-way key. Therefore, the speaker may be installed in the PDA to generate a desired audio effect without increasing the total thickness and size of the PDA, or reducing the size of the display screen. In order to form the carved opening on the circuit board, the circuit layout on the circuit board has to be properly designed to prevent from being interrupted. In addition, the interior of the four-way key and function keys is formed in a hollow manner to increase the acoustic space of the acoustic chest to improve the sound quality of the speaker. The bulged points to contact the touch switches of the circuit board are maintained. The membrane connecting the keys has troughs formed on the bottom thereof to communicate with the hollow space of the hollow keys so that the space of the acoustic chest may be increased to improve the sound quality of the speaker.

The foregoing, as well as additional objects, features and advantages of the invention will be more readily apparent from the following detailed description, which proceeds with reference to the accompanying drawings.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENT

The membrane button key structure with a built-in speaker of the invention has a housing compartment formed on the bottom of the membrane key to house a speaker so that the coupled electronic product such as a PDA can equip with audio function without increasing the total thickness or size of the product, or reducing the size of the display screen. Details of the invention are depicted below referring to the embodiment.

Figure 1:
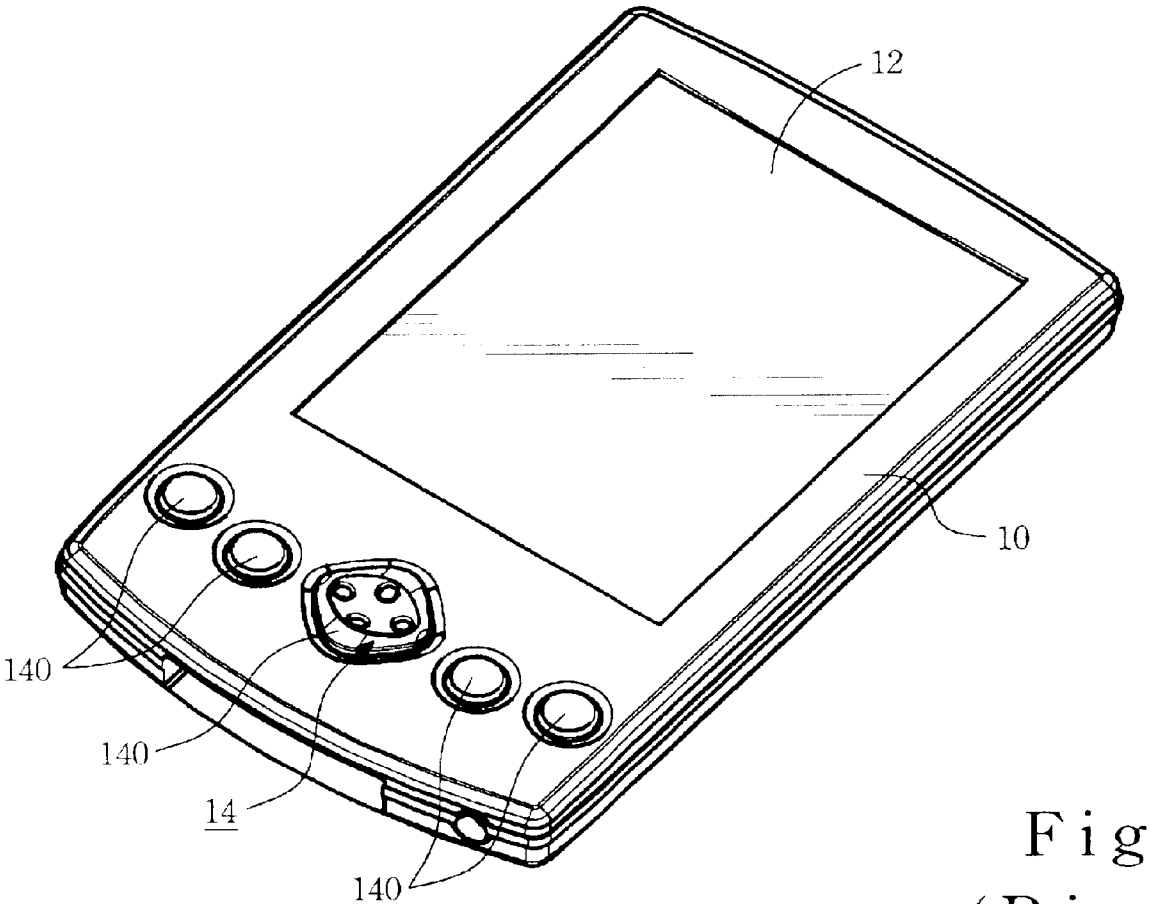
Fig. 1 (Prior Art)
FIG. 1 is a perspective view of a conventional PDA.
Figure 2:
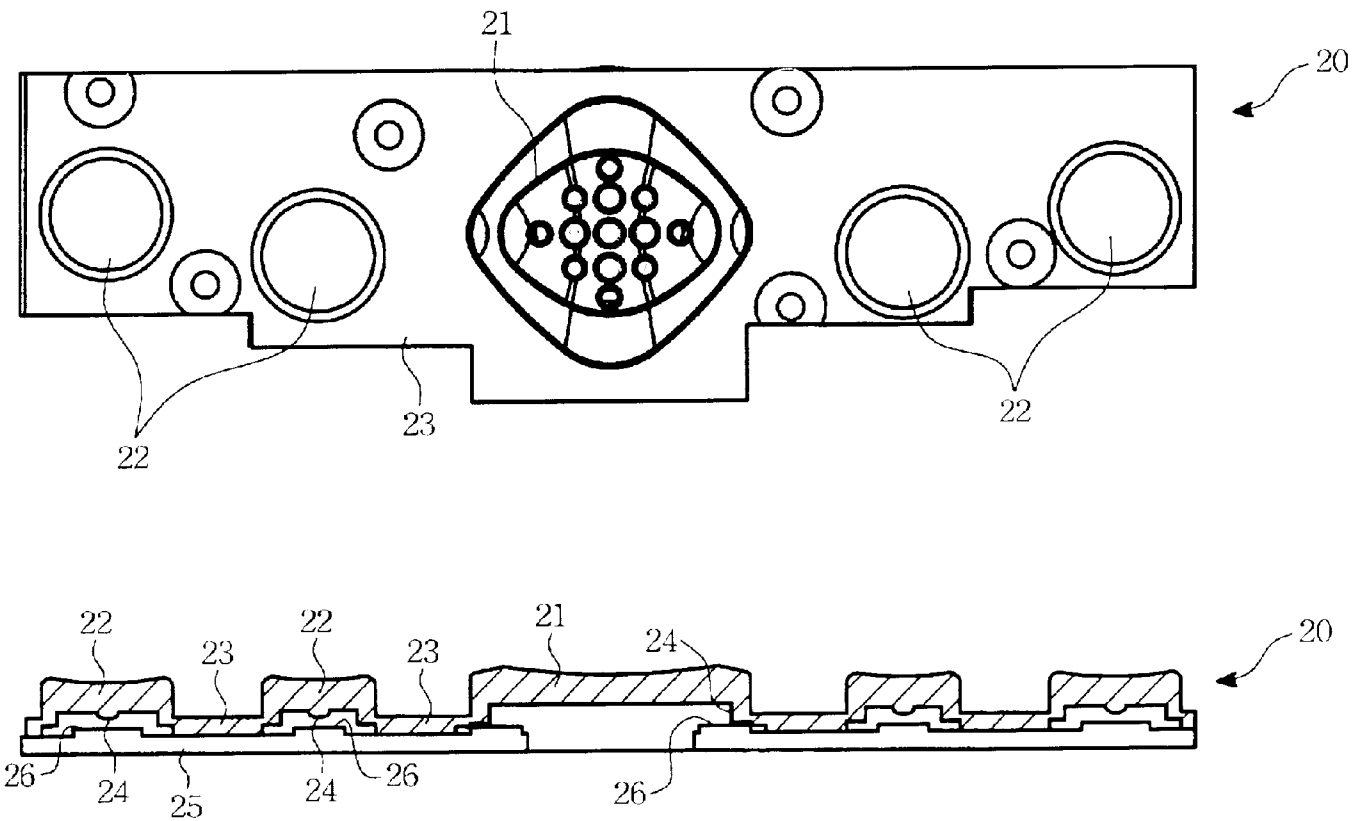
Fig. 2 (Prior Art)
FIG. 2 is a schematic view of a conventional membrane button key.
Figure 3:
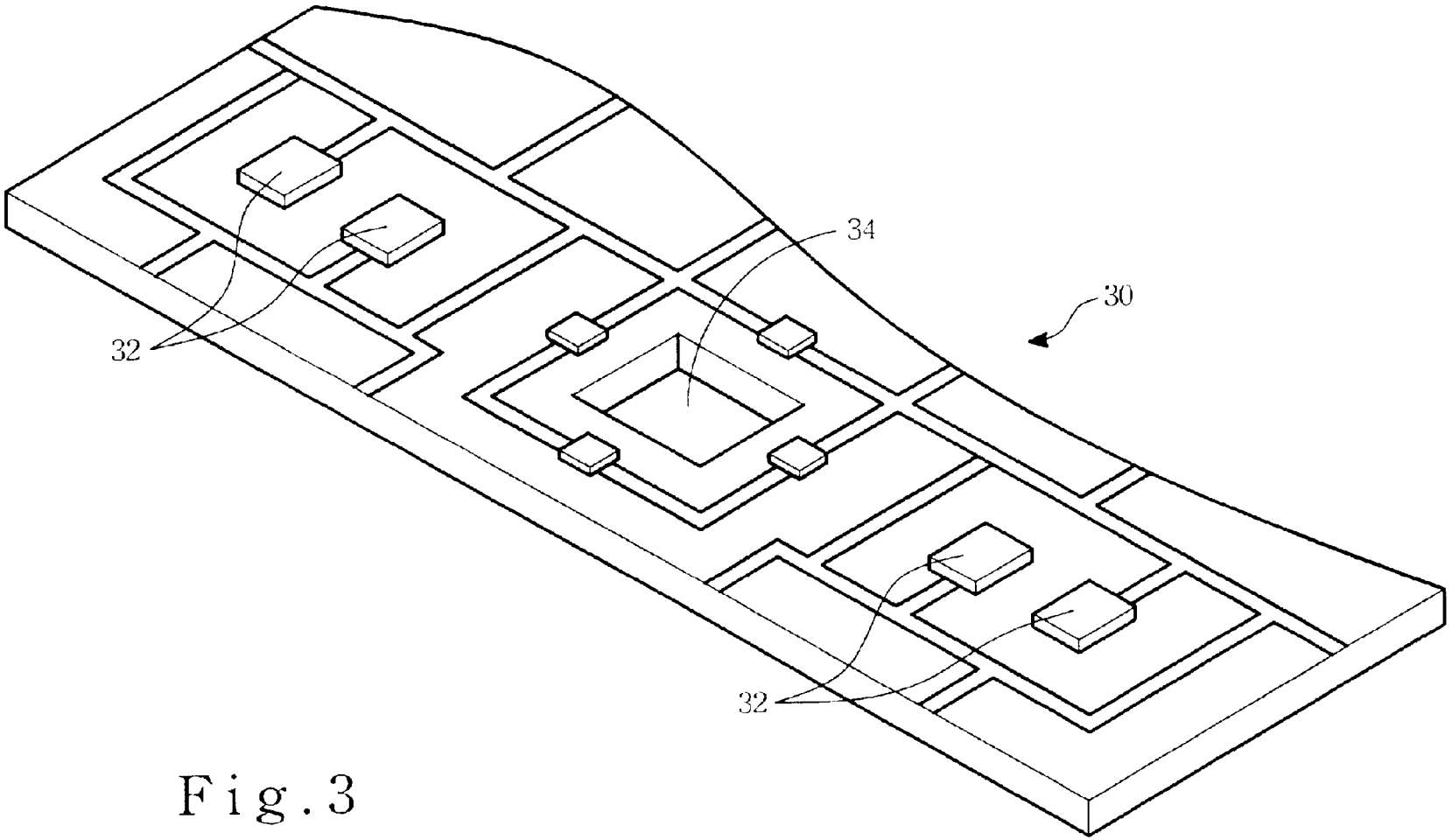
FIG. 3 is a schematic view of a circuit board of the invention.

The membrane button key structure with a built-in speaker of the invention is adopted on PDAs or related electronic products. Whatever the products, they must have a circuit board 30 located therein to couple with the membrane button key structure. Refer to FIG. 3 for an embodiment of the invention, the circuit board 30 has a plurality of touch switches 32 and a carved opening 34.

Figure 4:
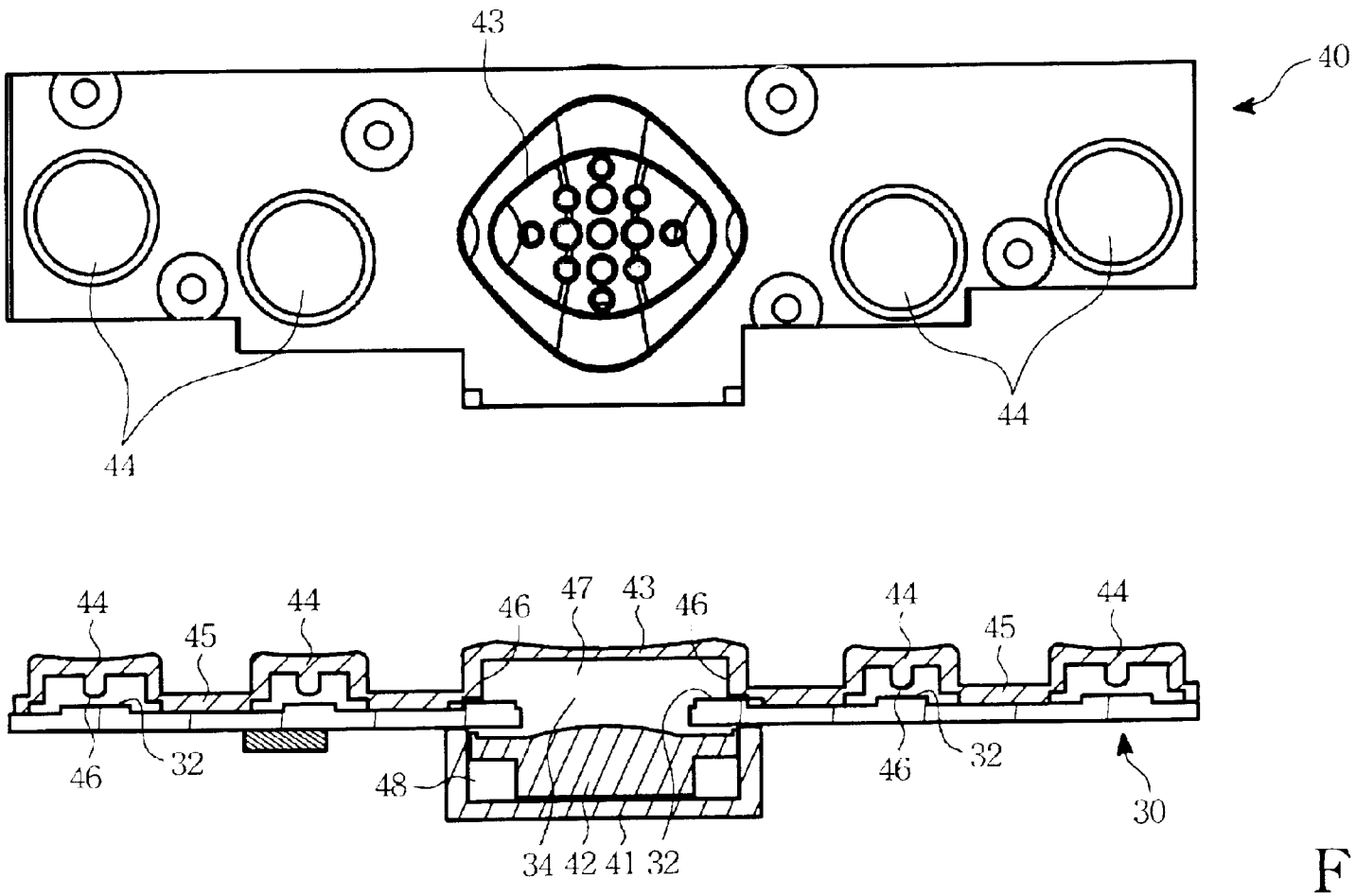
FIG. 4 is a schematic view of a membrane button key structure of the invention.

Referring to FIG. 4, the membrane button key structure of the invention includes a membrane key 40, a bottom lid 41 and a speaker 42. The membrane key 40 consists of a four-way key 43 and a plurality of hot keys 44. The keys 43 and 44 are connected by a membrane 45 integrally made from a pliable rubber. The four-way key 43 have four bulged points 46 formed at four corners on the bottom side thereof. Each hot key 44 also has a bulged point 46 located on the bottom side in the center. When the membrane key 40 is coupled with the circuit board 30 thereabove, each bulged point 46 on the bottom of the membrane key 40 corresponds to one touch switch 32 of the circuit board 30. In addition, the four-way key 43 is located above the carved opening 34. The periphery of the carved opening 34 also has four touch switches 32 corresponding to the four bulged points 46 of the four-way key 43. The bottom lid 41 is located below the carved opening 34 of the circuit board 30 to form a housing compartment with the four-way key 43 to accommodate the speaker 42. When the speaker 42 is held in the housing compartment, the extra space it forms with the four-way key 43 becomes an upper acoustic chest 47 of the speaker 42, while another extra space it forms with the bottom lid 41 becomes a lower acoustic chest 48 of the speaker 42.

As the speaker is housed in the space formed below the four-way key and the carved opening of the circuit board, it can provide the audio effect without increasing the total thickness and size of the PDA, or reducing the size of the display panel. In order to form the carved opening on the circuit board, the circuit design of the circuit board has to take special considerations to spare the opening required to avoid circuit interruption.

Figure 5:
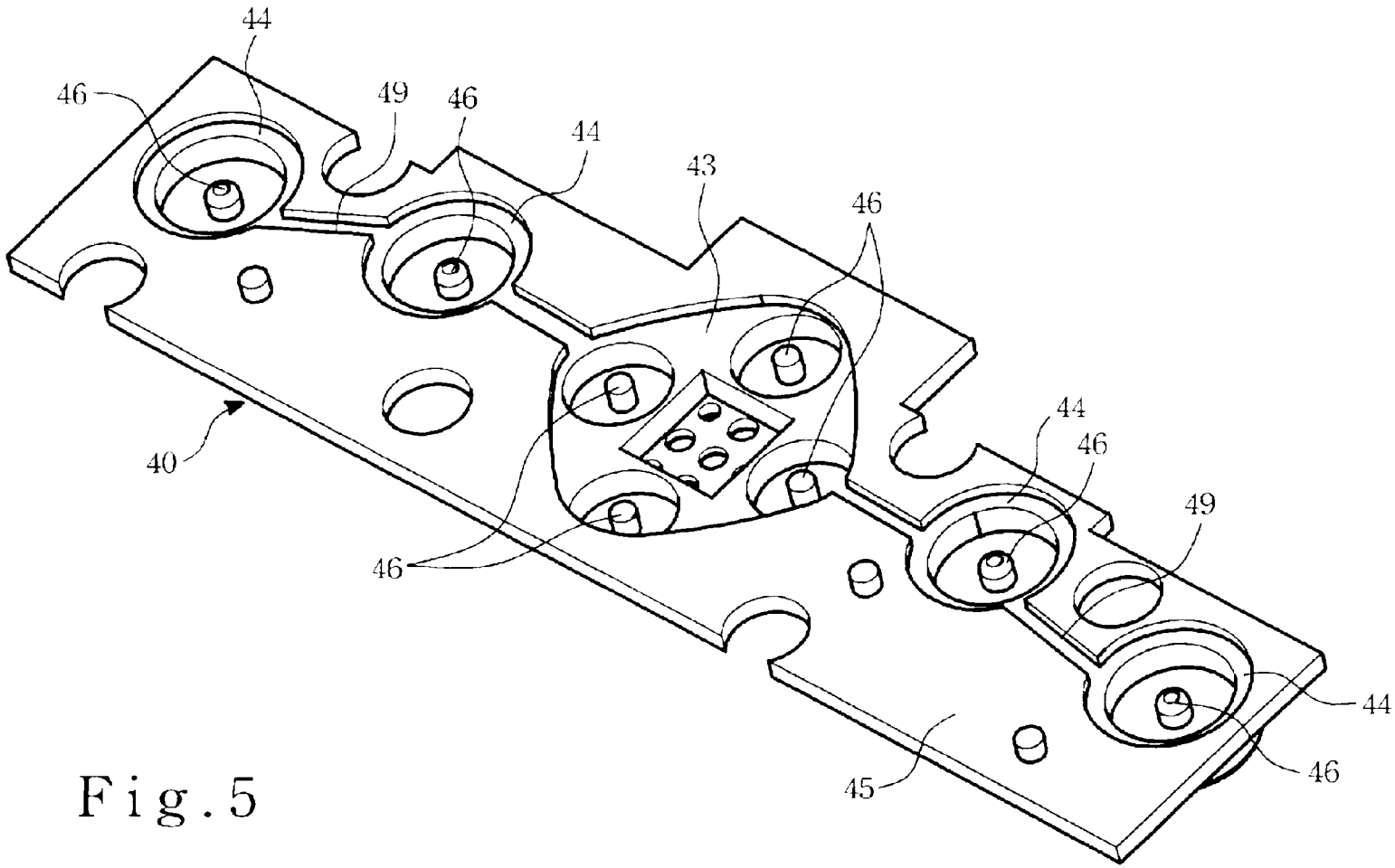
FIG. 5 is a bottom view of the membrane key of the invention.

In addition, the size of the acoustic chest directly affects the audio quality of the speaker. In order to improve the quality of the speaker, the four-way key 43 and the hot keys 44 of the invention are made with a hollow interior. Only the bulged points 46 required to contact the touch switches on the circuit board remain. The bottom of the membrane 45 is formed with troughs 49 to connect and communicate with the hollow interior of every key 43 and 44, and the compartment (upper acoustic chest) formed below the four-way key 43 to form a greater space for the upper acoustic chest (as shown in FIG. 5). Thus audio quality of the speaker can be improved.

While the preferred embodiment of the invention has been set forth for the purpose of disclosure, modifications of the disclosed embodiment of the invention as well as other embodiments thereof may occur to those skilled in the art. Accordingly, the appended claims are intended to cover all embodiments which do not depart from the spirit and scope of the invention.

What is claimed is:

1. A membrane button key structure with a built-in speaker for coupling with a circuit board which has a plurality of touch switches and an opening located on the surface thereof, comprising:

a membrane key including a four-way key and a plurality of hot keys connecting with one another through a membrane and corresponding to the touch switches, the four-way key being located above the opening of the circuit board;

a bottom lid located below the opening of the circuit board to form a housing compartment with the four-way key; and a speaker located in the housing compartment to spare a space in the housing compartment to form an audio chest for the speaker.

2. The membrane button key structure with a built-in speaker of claim 1, wherein the membrane is integrally made from a pliable rubber.

3. The membrane button key structure with a built-in speaker of claim 1, wherein the four-way key has four bulged points formed at four corners on the bottom side thereof, and each hot key has a bulged point located on the bottom side in the center thereof, the bulged points corresponding respectively to the touch switches of the circuit board.

4. The membrane button key structure with a built-in speaker of claim 3, wherein the four-way key and the hot keys are made with a hollow interior with the bulged points remained to contact the touch switches of the circuit board, the membrane having troughs formed on the bottom thereof to connect the keys to communicate with the hollow interiors of the keys and the compartment below the four-way key to increase the space of the acoustic chest of the speaker.

5. The membrane button key structure with a built-in speaker of claim 1, wherein the speaker and the bottom lid form a spare space to become a lower acoustic chest of the speaker.

6. The membrane button key structure with a built-in speaker of claim 1, wherein the speaker and the four-way key form a spare space to become an upper acoustic chest of the speaker.

* * * * *